US005357487A

United States Patent [19]

Coleman, III

[11] Patent Number: 5,357,487

[45] Date of Patent: Oct. 18, 1994

[54] VARIABLE TIME SEGMENT PACE TIMING DEVICE

[75] Inventor: James W. Coleman, III, Amherst, N.H.

[73] Assignee: Linkstime Management Systems, Inc., Amherst, N.H.

[21] Appl. No.: 639,986

[22] Filed: Jan. 11, 1991

[51] Int. Cl.[5] ..... G04B 47/00; G04F 8/00; A63B 69/36

[52] U.S. Cl. ..... 368/10; 368/108; 273/32 H; 273/176 L

[58] Field of Search ..... 368/10.3, 107–113, 368/223; 340/323 R; 364/410; 273/85 R, 32 H, 32 R, 176 R, 176 L

[56] References Cited

U.S. PATENT DOCUMENTS

| | | | |
|---|---|---|---|
| 3,895,799 | 7/1975 | Rinne | 273/85 R |
| 4,062,180 | 12/1977 | Meshi et al. | 368/96 |
| 4,396,904 | 8/1983 | Hanaoka | 340/309.15 |
| 4,632,570 | 12/1986 | Kelsey | 368/107 |
| 4,633,231 | 12/1986 | Kilian | 340/539 |
| 4,641,125 | 2/1987 | Pesa | 340/309.15 |
| 4,717,815 | 1/1988 | Tomer | 368/90 |
| 4,847,776 | 7/1989 | Huang | 364/467 |
| 4,879,553 | 11/1989 | Righi | 340/932.2 |
| 4,884,255 | 11/1989 | Fisher | 368/96 |
| 4,922,222 | 5/1990 | Baker | 340/323 R |
| 5,097,416 | 3/1992 | Matthews | 364/410 |

*Primary Examiner*—Vit W. Miska

*Attorney, Agent, or Firm*—Hayes, Soloway, Grossman, Hennessey & Hage

[57] ABSTRACT

A variable time segment pace timing apparatus which sequences a plurality of different time segments which comprises a timer housing, a timer contained in said housing wherein said timer is adjusted to a preset time and counts backwards from said preset time toward zero, a resource display contained in said timer housing which indicates which .resource is currently being utilized, an alarm, contained in said timer housing, operatively coupled to the time wherein said alarm sounds when said timer has reached the termination of an adjusted time duration, a means for activating said pace timing device contained in said timer housing having the function of clearing, resetting and starting the pace timing apparatus and a means for powering said pace timing device contained in said timer housing.

10 Claims, 3 Drawing Sheets

TEE-TIME SCHEDULING SHEET

| TIME | PARTY | TIME | PARTY |
|---|---|---|---|
| 7:00 | | ~ | |
| 7:08 | | ~ | |
| 7:16 | | ~ | |
| 7:24 | | ~ | |
| 7:32 | | ~ | |
| 7:40 | | ~ | |
| ~ | | ~ | |
| ~ | | ~ | |
| ~ | | ~ | |
| ~ | | ~ | |
| ~ | | ~ | |
| ~ | | 4:52 | |
| ~ | | 5:00 | |

VARIABLE TIME SEGMENT PACE TIMING DEVICE

BACKGROUND OF THE INVENTION

The present invention relates generally to the field of timing devices, particularly to the field of electronic pace timing devices in which a plurality of different time segments must be sequenced, and it aims to provide both method and device of said kind. The invention has particular utility for the game of golf whereby the golfer is informed as to remaining time and when a pre-determined time interval has transpired for a selected hole, thereby providing maximum utilization of a golf course, and will be described in connection with such utility, although other utilities are contemplated.

Electronic pace timing devices have been widely used in the prior art to determine the rate at which various physical actions are repetitively performed. Such physical actions are typified, for example, by the strides performed by a long-distance runner. During a long-distance race, it is necessary for each of the competitors to run at a pace which is best suited to their particular physical capabilities, with regard to the distance of the race. In order to determine this optimum running speed, it is necessary for the competitor to determine the relationship between running speed and the rate at which their physical capabilities become exhausted. A pace timing device has been an extremely valuable device in both the training and competition of the competitor, thereby indicating to the runner a fixed repetition frequency via an audible or visual signal. By adjusting the pace in accordance with the pace timing signals, the athlete can maintain the running speed at a desired fixed pace. See, for example, U.S. Pat. No. 4,396,904.

Another type of electrical timing device relates to an arrangement for monitoring the time period in which a person remains in a given closed region. Accordingly, a person is supplied with a transmitter which is adapted to transmit electromagnetic energy and comprises an energy storage device (energy source) and a timing member. When the transmitter is handed to the monitored person, and is adjusted to a desired time duration, it can be ascertained at least one central station when a visitor, for example, has exceeded a given time corresponding to a normal travelling time from an entry point to a place of destination. See, for example, U.S. Pat. No. 4,633,231.

While these inventions are useful, they do not deal with the most important part of a timekeeping process as it relates to those situations where a plurality of different time segments must be sequenced. In the game of golf, for example, this amounts to providing a golfer with information as to the overall pace of play so that all parties on a given course move efficiently and without reasonable delay from one playing hole to another. In other words, prior inventions have failed to provide a device to sequence a plurality of different time segments, maximize the use of a given golf course, or supply any method for parties on the golf course to conform their pace of play according to some previously established playing times for individual holes.

It is therefore a primary object of the present invention to provide an apparatus and a method in which a plurality of different time segments can be associated to a plurality of successive resources thereby providing an ability for the maximum number of individuals to make continuous and efficient use of said resources.

Further objects of the invention will appear as the description proceeds. To the accomplishment of the above and related objects, the invention may be embodied in the form illustrated in the accompanying drawings, attention being called to the fact, however, that the drawings are illustrative only and that changes may be made in the specific construction illustrated and described within the scope of the appended claims.

SUMMARY OF THE INVENTION

According to the present invention, a variable time segment pace time apparatus is described which sequences a plurality of different time segments and which comprises a timer housing, a time contained in said timer housing wherein said timer is adjusted to a preset time and counts backward from said preset time toward zero, a resource display contained in said timer housing, which indicates which resource is currently being employed, an alarm, contained in said housing, operatively coupled to the timer wherein said alarm sounds when said timer has reached the termination of an adjusted time duration, a means for activating said pace timing device contained in said timer housing having the function of clearing, resetting and starting the pace timing apparatus and a means for powering said pace timing device contained in said timer housing.

As to a golfer, the invention provides a way to conform his/her pace of play and to allow golf course managers to maximize the utilization of playing time on a golf course. According to this embodiment, this is achieved by a pace timing apparatus which sequences the plurality of different time segments made available to the golfer for each hole on the golf course. More particularly, said apparatus indicates to the golfer what hole he/she should be playing and how much time is left on the hole which is being played. The pace timing apparatus which aids a golfer in conforming his/her pace of play comprises a timer housing, a hole timer, contained in said timer housing, wherein said hole timer is adjusted to a preset time for each hole and counts backwards from said preset time toward zero, a hole display contained in said timer, which indicates which hole on the golf course is being played, an alarm contained in said timer housing operatively coupled to the hole timer wherein said alarm sounds when said hole timer has reached the termination of an adjusted time duration, a means for activating said pace timing device contained in said timer housing having the function of clearing, resetting and starting the pace timing apparatus and a means for powering said pace timing apparatus also contained in said timer housing. In method form a golfer is supplied with the pace timing device as described herein which is activated and adjusted to a preset time for each hole thereby indicating to the golfer which hole on the golf course is to be played, when the golfer should be on the green and when the golfer should terminate play on a given hole.

BRIEF DESCRIPTION OF THE DRAWINGS

The figures in the drawings are briefly described as follows.

DETAILED DESCRIPTION OF THE PREFERRED EMBODIMENTS

Figures 1, 3:
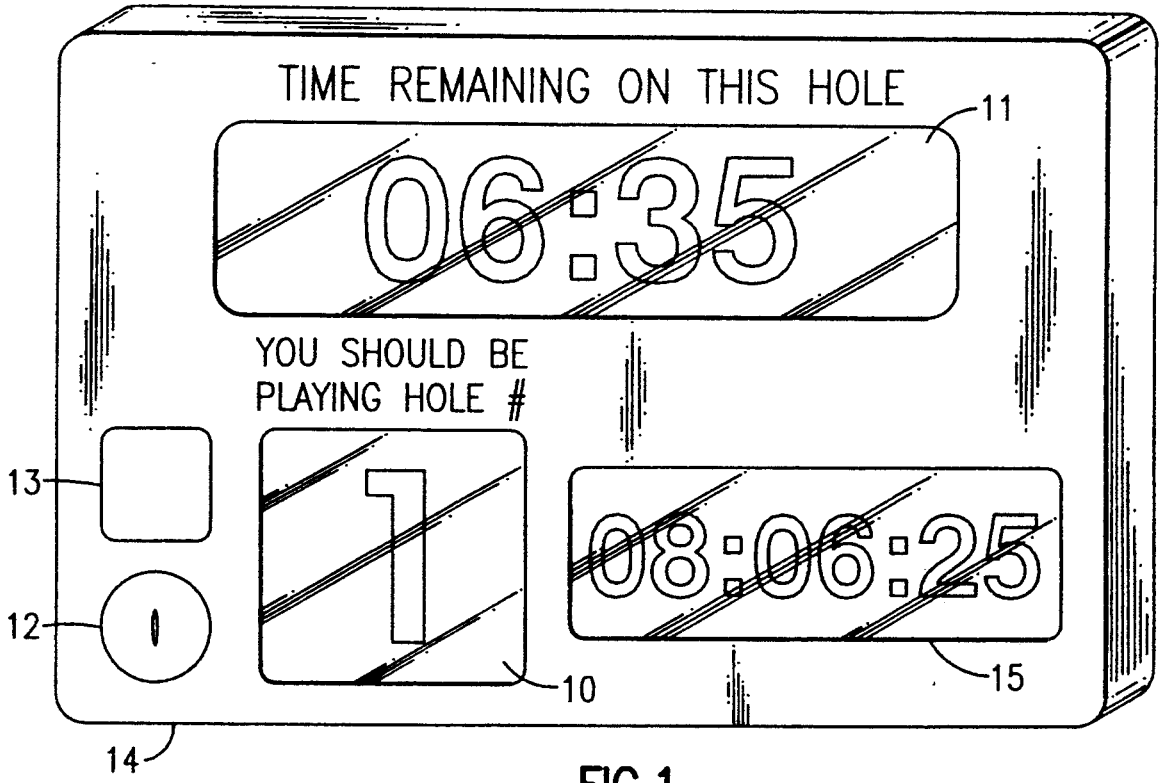
FIG. 1 shows diagrammatically an apparatus according to the invention.
FIG. 3 shows a scheduling sheet useful in accordance with the present invention.

The operation of the pace timing apparatus of the invention may best be understood with reference to FIG. 1. The hole display 10 indicates which hole on the golf course is presently being played. The hole timer display 11 indicates the amount of time remaining on the hole indicated in the hole display. In general, the amount of time allocated for each hole will be adjusted to provide reasonable playing time for a given party and may reflect the number of individuals in the party, their skill level, and prevailing conditions. In such a manner, maximum utilization of the golf course can be achieved. In a preferred embodiment, the amount of time each party is allocated to complete 18 holes is about 4–5 hours.

The key unit switch 12 is for powering up of the unit. The unit will normally sound a tone (or alarm) at about the 5 minute mark on each hole (a greens prompt). This is to remind the golfer that he/she should be preparing for greens play (e.g. putting). A switch 13 comprises a means for deactivating the alarm associated with the greens prompt. The unit will sound a tone (or alarm) when the hole timer display indicates 00:00. This indicates to the golfer that he/she has used all allotted time for that hole and should be moving to the next hole. A means for activating said pace timing apparatus is embedded inside and at the side of the unit at 14, and in a preferred embodiment, comprises magnetic reed switches. Such magnetic reed switches are accessed only by passing a magnet of specific strength over the appropriate area on the unit. These switches have the additional function of clearing, resetting and starting the program for the holes to be played. The pace timing apparatus may optionally contain a time of day clock 15 for the convenience of the golfer.

Figure 2A:
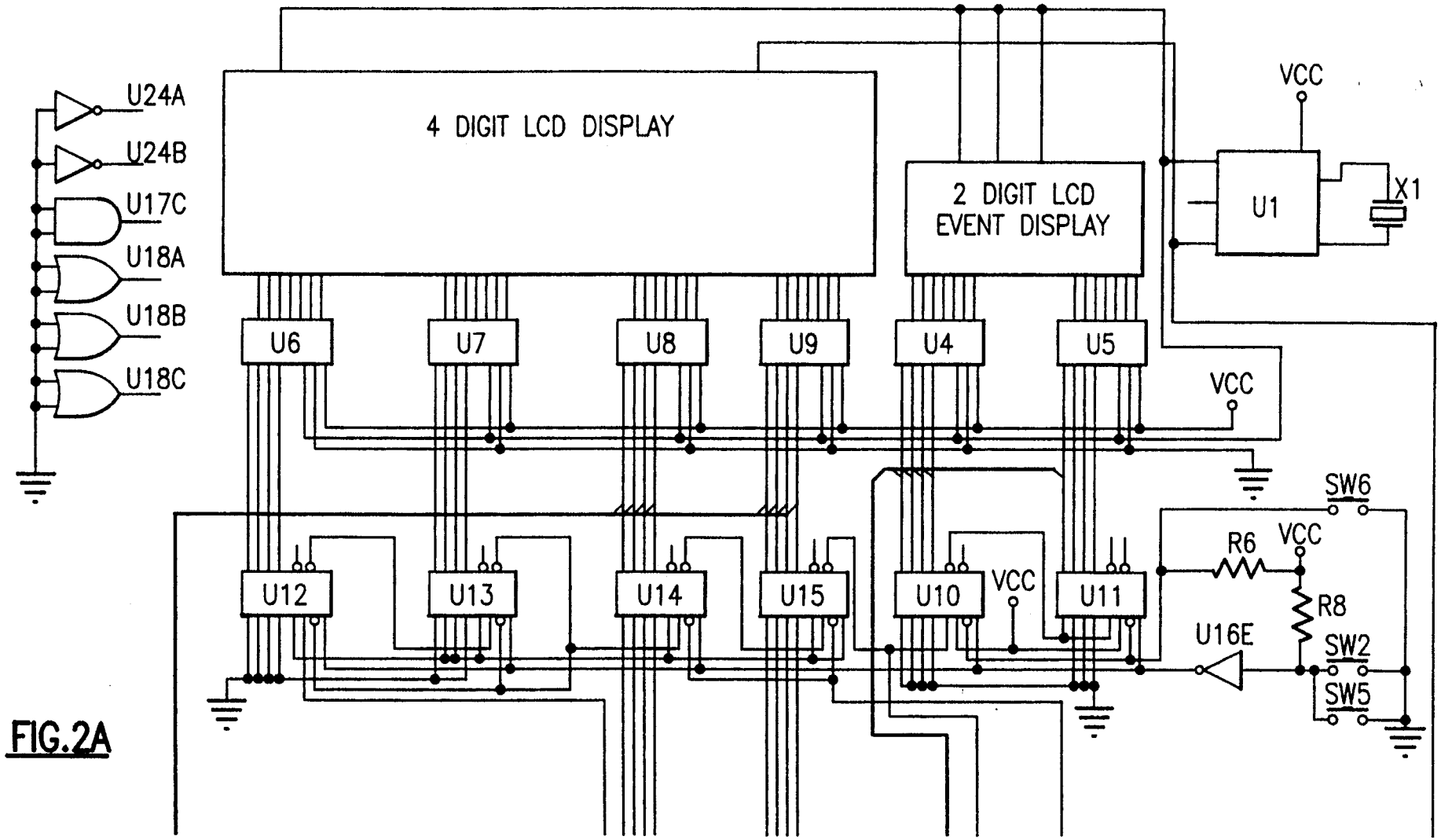
FIGS. 2A and 2B show a circuit diagram of the pace timing device according to the present invention having the basic configuration shown in FIG. 1.
Figures 2, 2B:
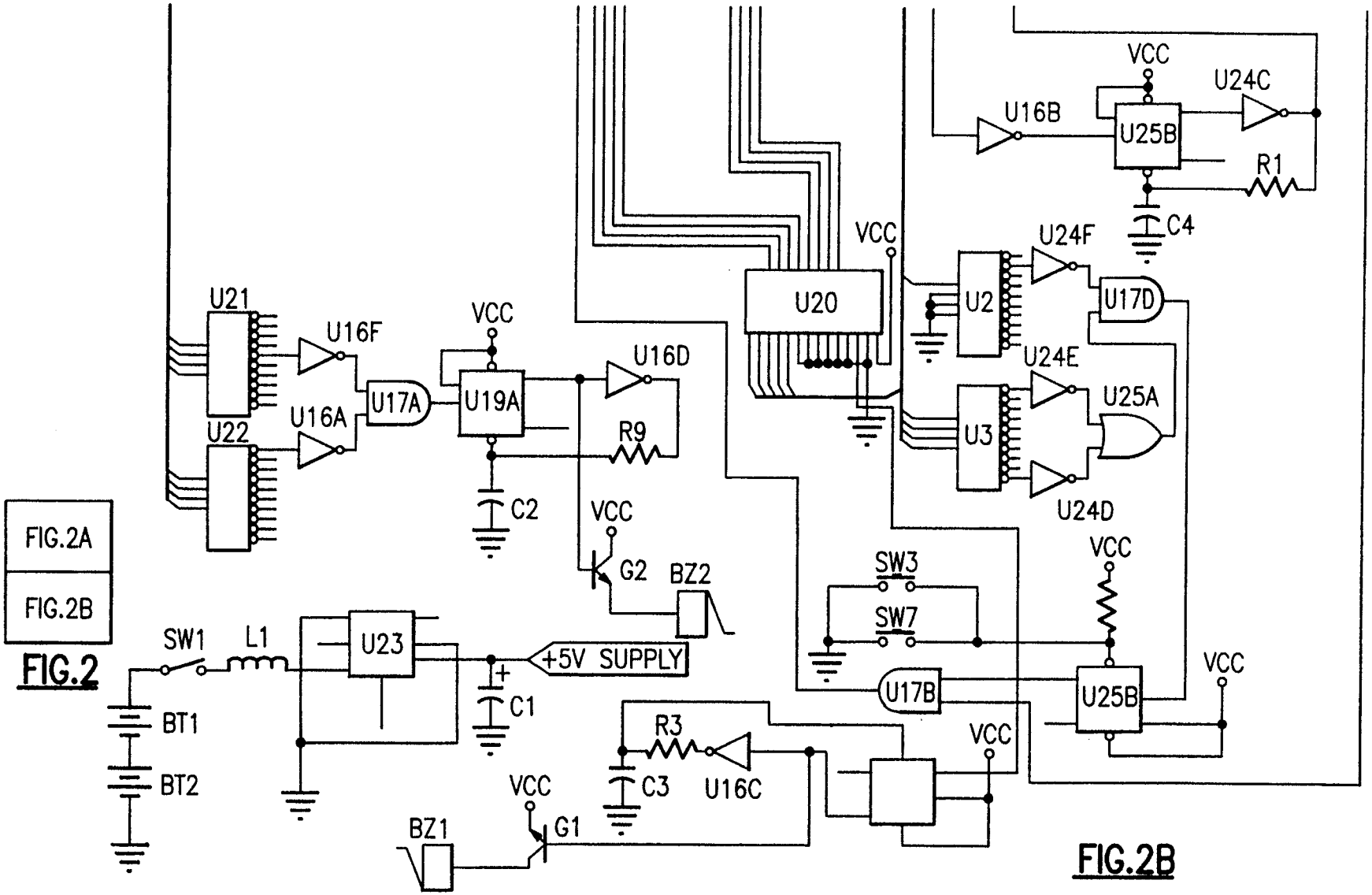

More particularly, and with reference to FIGS. 2A, 2B, when counters U12–U15 are zero, the borrow functions of counter U15 sends a pulse to counter U10 to step up the event count to 1. At the same time the pulse is also sent to flip flop U25 which produces a slight delay which feeds the PROM and loads its data in registers U14 and U15 and countdown starts 1 second at a time until counters U21 and counters U22 sense that there is about 5 minutes of time left. At that time, a warning delay pulse is applied to the alarm B21 and a solid alarm of about 8 seconds will sound, while the count continues to count until zero. At zero a pulse is applied to flip flop U19B which places a one second pulse to the alarms for about 10 seconds to signal the end of that event. Decoders U2 and U3 are used to detect when the event is either 10 or 19. When this is detected a pulse is applied to flip flop **U25*a* which inhibits the one second pulse and the timer stops. Power is achieved by the use of 2AA batteries and a maxim max 631** power supply. Due to the use of CMOS devices the total current drain is less than 10 mills, allowing for many hours of use on one set of batteries.

In method form, the starter attaches the pace timing apparatus to the golf bag or cart. The starter can then make reference to a tee-time scheduling sheet, which provides and coordinates information with regards to the time of year and length of daylight hours, the number of other parties on the course, their respective starting times, where said parties should be on the course at a given time, and the expected time for said party to complete play. Another feature of the scheduling sheets is providing two starting tee-times to eighteen hole players; one time for the first nine holes, one time for the second nine holes. With such information, the starter can then select the proper time of day to sequence additional parties onto the golf course in a manner that provides maximum and efficient use of said course. The starter powers up the unit with a key inserted at 12 and in a preferred embodiment activates said unit by passing a magnet over a designated area on the unit (13) (FIG. 1). At this point the unit will immediately begin its timing function. After a given number of holes are completed, the unit will stop its timing function and wait to be restarted for the next series of holes again using a magnet over the appropriate area on the unit.

The system also advantageously contains two starter's clocks these are large display clocks positioned on the golf course which provide the starter with information as to when players should be sequenced onto said golf course. Finally the system will include strategically placed instruction signs, reminder signs and course marking, all designated to help speed up play.

While certain novel features of this invention have been shown and described and are pointed out in the annexed claims, it will be understood that the various omissions, substitutions and changes in the forms and the details of the device illustrated and in its operation can be made by those skilled in the art without departing from the spirit of the invention.

What is claimed is:

1. A variable time segment pace timing apparatus in which a plurality of different time segments are sequenced for a golfer comprising:

(a) a timer housing;

(b) a hole timer, contained in said timer housing, wherein said hole timer is adjusted to a preset time for each hole and counts backward from said preset time toward zero;

(c) a hole display, contained in said timer, which indicates which hole on the golf course is presently being played;

(d) an alarm, contained in said timer housing, operatively coupled to the hole timer wherein said alarm sounds when said hole timer has reached the termination of an adjusted time duration;

(e) means for activating said pace timing device, contained in said timer housing, having the function of clearing, resetting and starting the pace timing apparatus; and (f) means for powering said pace timing device, contained in said timer housing.

2. The pace timing device of claim 1, wherein said activating means comprises a magnetic reed switch which can be accessed by passing a magnet over an area of the unit.

3. The pace timing device of claim 1, wherein the alarm sounds at a point in time before the end of a hole sufficient to warn the golfer to prepare for greens play.

4. The pace timing device of claim 3, and further comprising means for deactivating said alarm.

5. The pace timing device of claim 1 wherein the powering means comprises a self-contained energy source for supplying electric energy to said pace timing device and is engagable upon insertion of a key into said timing device.

6. The pace timing device of claim 1 and further comprising means for attaching said device to a golf bag or cart.

7. A method for sequencing a plurality of different time segments thereby maximizing the utilization of playing time on a golf course comprising:

(a) supplying a golfer with the pace timing device of claim 1; and (b) activating said device wherein said hole timer is adjusted to a preset time for each hole thereby indicating to the golfer which hole on the golf course is to be played, when the golfer should be on the green, and when the golfer should terminate play on a given hole.

8. The method of claim 6, wherein the pace timing device is adjusted to a given time duration for a given hole.

9. A variable time segment pace timing device for golf in which a plurality of different time segments are sequenced comprising:

(a) a timer housing:

(b) a hole timer, contained in said timer housing, wherein said hole timer is adjusted to a preset time for each hole and counts backward from said time toward zero, said preset time based upon the time of year and length of daylight hours, the number of other parties on the course, said parties' respective starting times, where said parties should be on the course at a given time, and the expected time for said party to complete play;

(c) a hole display, contained in said timer, which indicates which hole on the golf course is presently being played;

(d) an alarm, contained in said timer housing, operatively coupled to the hole timer wherein said alarm sounds when said hole timer has reached the termination of an adjusted time duration;

(e) means for activating said pace timing device, contained in said timer housing, having the function of clearing, resetting and starting the pace timing apparatus;

(f) means for powering said pace timing device, contained in said timer housing; and (g) starter's clocks which provide information as to when additional players can be sequenced onto said golf course.

10. A method for sequencing a plurality of different time segments thereby maximizing the utilization of playing time on a golf course comprising supplying a golfer with the pace timing device of claim 9, selecting a preset time to sequence players onto said golf course and activating said device at the selected time wherein said hole timer is adjusted to a preset time for each hole thereby indicating to the golfer which hole on the golf course is to be played, when the golfer should be on the green, and when the golfer should terminate play.

* * * * *